US007255072B2

(12) United States Patent
Yamaguchi

(10) Patent No.: US 7,255,072 B2
(45) Date of Patent: Aug. 14, 2007

(54) TWO-STROKE INTERNAL COMBUSTION ENGINE

(75) Inventor: Shirou Yamaguchi, Ome (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 11/438,988

(22) Filed: May 23, 2006

(65) Prior Publication Data

US 2006/0266310 A1 Nov. 30, 2006

(30) Foreign Application Priority Data

May 24, 2005 (JP) ..... 2005-150603

(51) Int. Cl.
*F02B 25/00* (2006.01)
*F02B 33/04* (2006.01)

(52) U.S. Cl. ..... 123/73 AA; 123/73 FA

(58) Field of Classification Search ..... 123/73 AA, 123/73 FA
See application file for complete search history.

(56) References Cited

U.S. PATENT DOCUMENTS

2003/0051684 A1* 3/2003 Laydera-Collins ..... 123/73 AA

FOREIGN PATENT DOCUMENTS

JP 2002276377 A * 9/2002

* cited by examiner

*Primary Examiner*—Noah P. Kamen
(74) *Attorney, Agent, or Firm*—Kilyk & Bowersox, P.L.L.C.

(57) ABSTRACT

In a two-stroke internal combustion engine (1) using an internal cooling piston (2), the piston (2) has in-piston scavenging passages (19) defined therein by partition walls (18), and lower-end inlets (20) of the in-piston scavenging passages (19) are opened downward and narrowed in opening area by piston pin bosses (16). In-cylinder scavenging passages (14), which are opened and closed as the piston (2) moves, are supplied with an air-fuel mixture from the narrowed lower-end inlets (20) through the in-piston scavenging passages (19). Thereby, a fresh air-fuel mixture is increased in flow rate when flowing from the in-cylinder scavenging passages (14) to the combustion chamber (10), and the scavenging efficiency of the engine is improved.

6 Claims, 8 Drawing Sheets

TWO-STROKE INTERNAL COMBUSTION ENGINE

BACKGROUND OF THE INVENTION

1. Field of the Invention

The present invention generally relates to two-stroke internal combustion engines, and more particularly, to engines having a relatively small displacement and that can be used on a portable power working machine.

2. Related Background Art

In small two-stroke internal engines, all the strokes including suction, compression, expansion and exhaust strokes are controlled by a piston-ported control system. During the exhaust stroke, the combustion chamber is scavenged of burnt gas from an air-fuel mixture including fuel and lubrication oil. More specifically, a fresh air-fuel mixture is first introduced into a crank chamber in which it will be compressed by a descending piston (during the expansion stroke). Subsequently, in the exhaust stroke, the combustion chamber is scavenged of burnt gas from the fresh air-fuel mixture compressed in the crank chamber and introduced into the combustion chamber.

There are known ways of scavenging, one being a method of introducing a fresh air-fuel mixture in the crank chamber directly into the combustion chamber through a scavenging passage formed in the inner wall of a cylinder, and another being a method of introducing a fresh air-fuel mixture into the combustion engine via apertures formed in the circumferential surface of the piston as disclosed in the Japanese Utility Model Laid Open No. 33232 of 1982 (patent document 1) and Japanese Patent Laid Open No. 1359 of 1985 (patent document 2). The piston having such apertures is called an "internal cooling piston".

Note here that because of worldwide concern, more environmentally friendly devices are in demand, and regulations have not only been imposed upon the emission of exhaust gas from automotive and motorcycle engines but also from two-stroke internal combustion engines having a relatively small displacement and used on a knapsack-type duster or chain saw. On this account, Japanese Patent Laid Open No. 2002-227652 (patent document 3) discloses a two-stroke internal combustion engine capable of reducing the amount of a so-called blow-by phenomenon, namely the phenomenon that a part of an air-fuel mixture, that is to be used for scavenging during the exhaust stroke, is discharged from the combustion chamber to outside the engine without contributing to the combustion. More particularly, this patent document 3 proposes to narrow the inlet of the scavenging passage formed in the inner wall of the cylinder. In other words, patent document 3 proposes to narrow the inlet opening area of the scavenging passage which is adjacent to the crank chamber compared to the cross-sectional area of the other part of the scavenging passage.

SUMMARY OF THE INVENTION

It is therefore preferable to overcome the above-mentioned drawbacks of the related art by providing a two-stroke internal combustion engine using an internal cooling piston and capable of reducing blow-by of exhaust gas.

According to a first aspect of the present invention, there is provided a two-stroke internal combustion engine including a cylinder having in-cylinder scavenging passages formed therein and a piston fittingly inserted in the cylinder and having piston apertures formed in a circumferential surface thereof. After an air-fuel mixture that has been introduced in a crank chamber is compressed by a descending movement of the piston, the compressed air-fuel mixture is supplied to the combustion chamber from the piston apertures through the in-cylinder scavenging passages to force out exhaust gas to an exhaust port and thereby scavenge the combustion chamber. The two-stroke internal combustion engine is characterized in comprising piston apertures having an opening area smaller than the cross-sectional area of the in-cylinder scavenging passages.

In existing engines using an internal cooling piston, an air-fuel mixture is supplied from piston apertures formed in the circumferential surface of the piston to the combustion chamber through in-cylinder scavenging passages to scavenge the combustion chamber. In the first aspect of the invention, however, the opening area of the piston apertures is smaller than the cross-sectional area of the in-cylinder scavenging passages such that the fresh air-fuel mixture can be discharged at an increased rate from the in-cylinder scavenging passages to the combustion chamber, thereby efficiently forcing out the exhaust gas from inside the combustion chamber.

According to a second aspect of the present invention, there is provided a two-stroke internal combustion engine including a cylinder having in-cylinder scavenging passages formed therein and a piston fittingly inserted in the cylinder and having piston apertures formed in a circumferential surface thereof. After an air-fuel mixture that has been introduced in a crank chamber is compressed by a descending movement of the piston, the compressed air-fuel mixture is supplied to the combustion chamber from the piston apertures through the in-cylinder scavenging passages to force out exhaust gas to an exhaust port and thereby scavenge the combustion chamber. The two-stroke internal combustion engine is characterized in comprising in-piston scavenging passages defined by partition walls provided inside the piston to communicate with the piston apertures, said in-piston scavenging passages being in communication with the crank chamber.

In existing internal cooling piston engines, the entire area of the internal cavity of the piston is used as an in-cylinder scavenging passage and the air-fuel mixture is supplied from the in-piston scavenging passage to the combustion chamber through the piston apertures and in-cylinder scavenging passage to scavenge the combustion chamber. In the present invention, however, the effective cross-sectional area of the in-piston scavenging passage is narrowed and the air-fuel mixture in the crank chamber is supplied via the narrowed in-piston scavenging passage to the combustion chamber to scavenge the latter. By passing the air-fuel mixture through the narrowed in-piston scavenging passage, the fresh air-fuel mixture can be discharged at an increased flow rate from the in-cylinder scavenging passage to the combustion chamber, thereby efficiently forcing out the exhaust gas from inside the combustion chamber.

In a preferred embodiment of the present invention, since inlets are narrowed for the air-fuel mixture in the crank chamber to flow into the in-piston scavenging passages, mixing of the fuel and air contained in the mixture can be promoted during its flow from the crank chamber into the in-piston scavenging passages, and separation of a lubrication oil, if contained in the mixture, can be promoted as well, thereby preventing excessive supply of oil to the combustion chamber and contamination of the exhaust gas.

In another preferred embodiment of the present invention, the air-fuel mixture discharged from the in-cylinder scavenging passages to the combustion chamber is directed away from the exhaust port. Thus, Schnurle (reversal type) scavenging can be performed to enhance the scavenging efficiency and prevent "blow-by of scavenging gas".

DETAILED DESCRIPTION OF THE INVENTION

The present invention will be described in detail by way of embodiments thereof with reference to the accompanying drawings.

Figure 1:
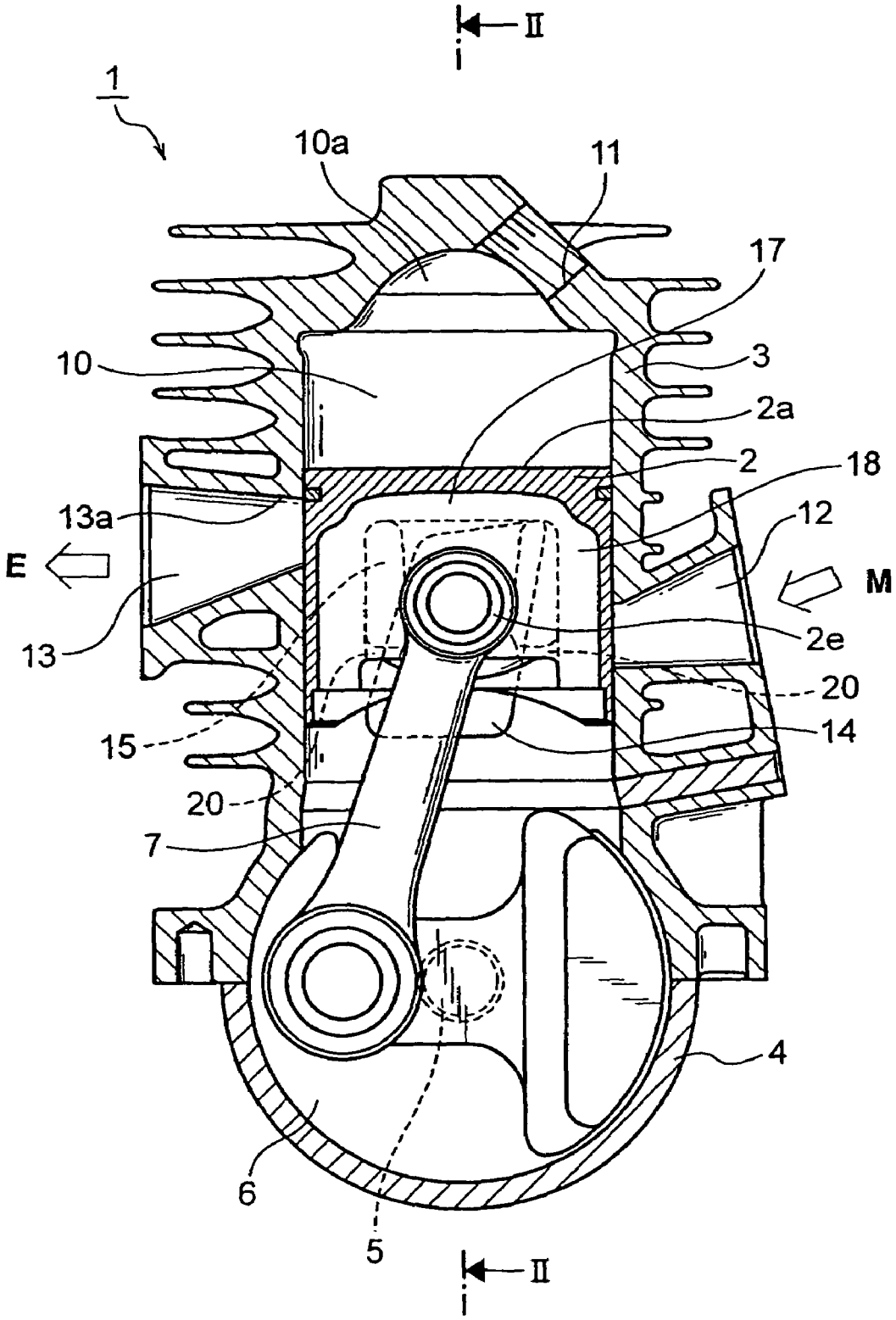
FIG. 1 shows a longitudinal sectional view of a two-stroke internal combustion engine as an embodiment of the present invention, taken along a direction across the crank shaft.
Figure 2:
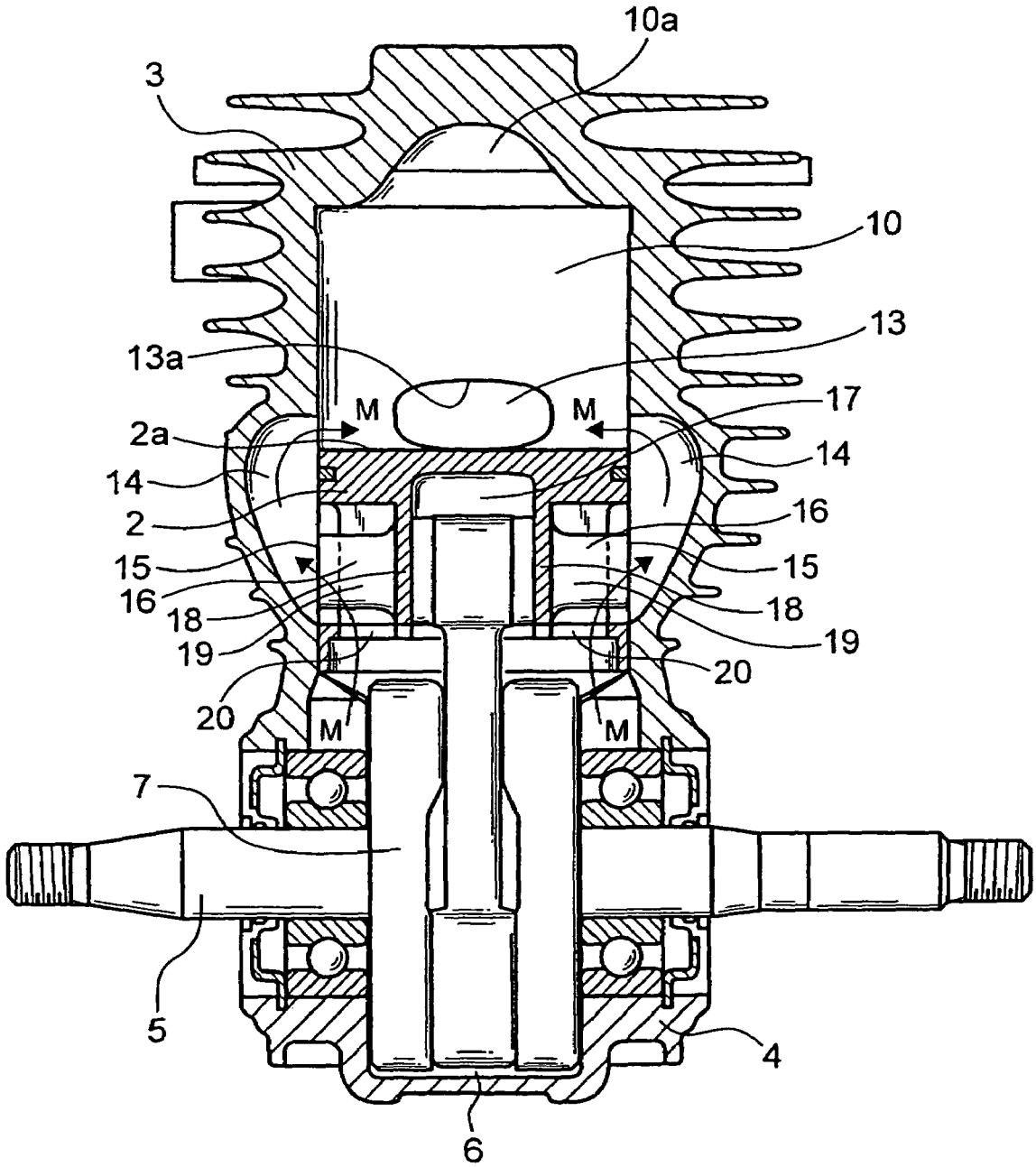
FIG. 2 also shows a longitudinal sectional view of the two-stroke internal combustion engine of FIG. 1, taken along the axial line of the crankshaft.

FIG. 1 illustrates a two-stroke internal combustion engine 1 according to embodiments of the present invention schematically in the form of a longitudinal sectional view taken along a plane across the crankshaft. FIG. 2 shows a longitudinal sectional view of the same engine, taken along the crankshaft. The engine 1 in embodiments is a single-cylinder air-cooled two-stroke gasoline engine. The engine 1 includes a piston 2, cylinder 3 fittingly receiving the piston 2 therein, and crank case 4 connected to the lower end of the cylinder 3. The crankcase 4 defines a crank chamber 6 that accommodates the crankshaft 5. The reciprocal up/down motion of the piston 2 is converted to a rotary motion by the crankshaft 5 connected via a connecting rod 7 to the piston 2.

In the cylinder 3, a combustion chamber 10 is defined above the piston 2. The combustion chamber 10 has a semispherical dome-shaped top portion 10*a*. An ignition plug (not shown) is screwed into a screw hole 11 to face the top portion 10*a* of the combustion chamber 10. The cylinder 3 has a suction port 12 and an exhaust port 13 disposed at different heights, respectively, and opposed to each other in a direction perpendicular to the axial line of the crankshaft 5. In addition, the cylinder 3 has formed therein a pair of right and left scavenging passages 14 that are opposed to each other in the axial direction of the crank shaft 5 (for simplicity of illustration, only one of the scavenging passages 14 is shown in FIG. 1).

Figure 3:
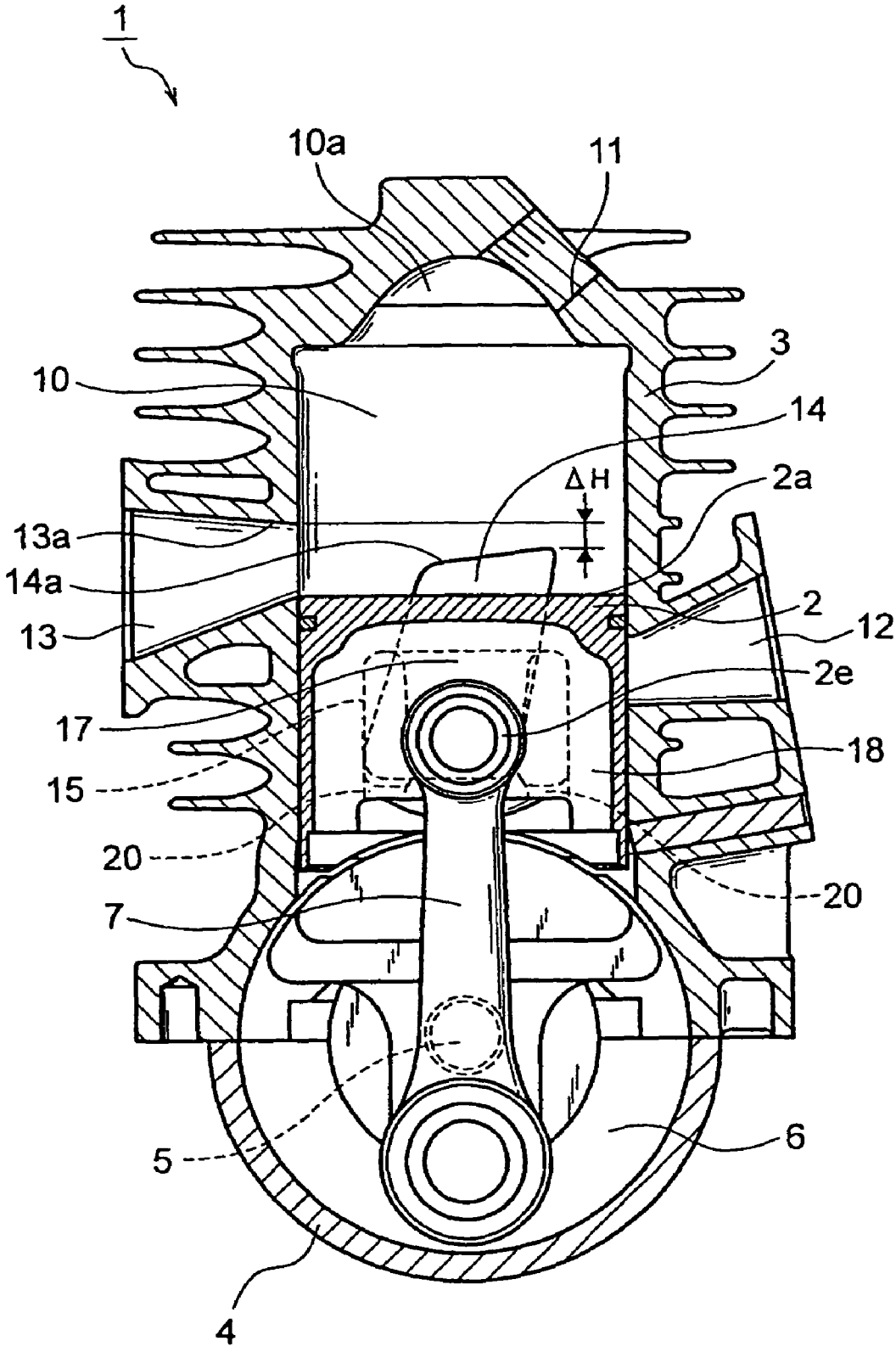
FIG. 3 shows a longitudinal sectional view corresponding to FIG. 1, in which the piston is at the bottom dead center.

FIG. 3 is a longitudinal sectional view corresponding to FIG. 1, in which the piston 2 is at the bottom dead center. As shown in FIG. 3, the exhaust port 13 becomes fully open when the piston 2 arrives at the bottom dead center. The exhaust port 13 is disposed such that its upper edge 13*a* is at a level slightly higher than upper edges 14*a* of the in-cylinder scavenging passages 14 (see ΔH in FIG. 3). Therefore, slightly after the piston 2 moves down to start the exhaust stroke, a compressed air-fuel mixture M is introduced from the in-cylinder scavenging passages 14 into the combustion chamber 10 by the piston 2 descending in the crank chamber 6. The upper edge 14*a* of each of the in-cylinder scavenging passages 14 is formed to depict a line inclined upward from the horizontal direction. Thus, at the initial stage in which the piston 2 moves down and opens the in-cylinder scavenging passages 14, the opened area of the in-cylinder scavenging passage 14, defined by a top surface 2*a* of the piston 2, increases gradually.

In the two-stroke internal combustion engine 1, like existing two-stroke internal combustion engines, the fresh air-fuel mixture M including a lubrication oil is introduced into the crank chamber 6 through the suction port 12 and the fresh air-fuel mixture M thus introduced in the crank chamber 6 is compressed by the piston 2 descending during the expansion stroke. When the piston 2 further descends, the exhaust port 13 is first opened to start the exhaust stroke, and the fresh air-fuel mixture M compressed in the crank chamber 6 is next introduced into the combustion chamber 10 through the in-cylinder scavenging passages 14. Thus, the combustion chamber 10 is scavenged. According to embodiments, the piston 2 is of an internal cooling type. The fresh air-fuel mixture M in the crank chamber 6 is supplied to the in-cylinder scavenging passages 14 via the piston 2.

Figure 4:
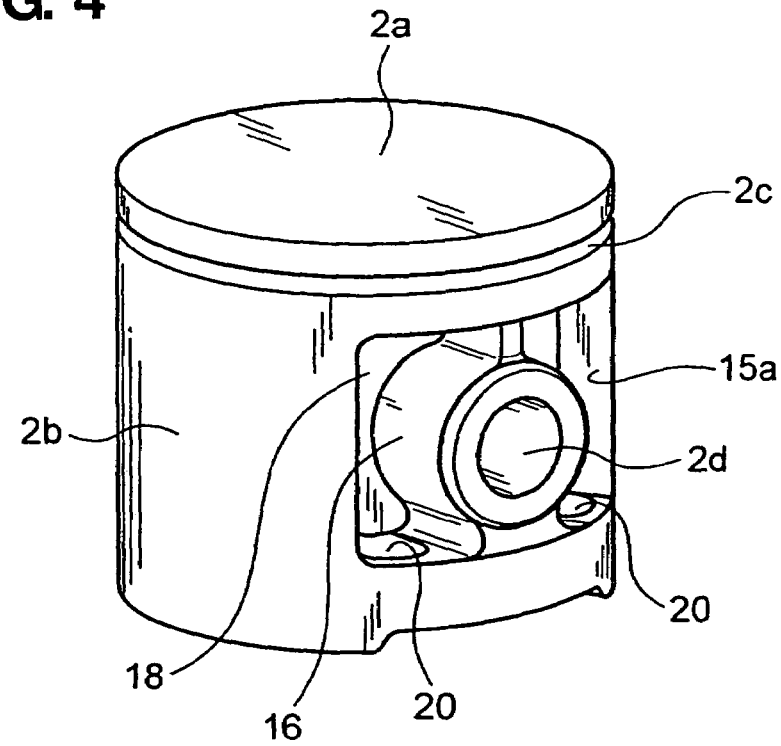
FIG. 4 is a perspective view of the internal cooling piston in the two-stroke internal combustion engine according to the same embodiment.

The piston 2 can be made of an aluminum alloy. As shown in FIG. 4, the piston 2 includes the top surface 2*a* defining the combustion chamber 10 and a cylindrical circumferential surface 2*b* extending from the top surface 2*a*. The circumferential surface 2*b* has a piston ring groove 2*c* formed in its upper end portion, and a piston pin hole 2*d* formed in its middle-height portion. The piston 2 is connected to the upper end of the connecting rod 7 with a piston pin 2*e* inserted in the piston pin hole 2*d* as shown, for example, in FIG. 3.

Similar to pistons used in conventional two-stroke internal combustion engines, the piston 2 has a pair of opposed rectangular apertures 15 formed in the circumferential surface 2*b* to surround the piston pin hole 2*d* such that the fresh mixture in the crank chamber 6 is supplied through the in-cylinder scavenging passages 14. That is to say, when the apertures 15 formed in the circumferential surface 2*b* of the piston 2 each face a corresponding one of the in-cylinder scavenging passages 14, the fresh air-fuel mixture M in the crank chamber 6 is supplied to the in-cylinder scavenging passages 14 through the piston apertures 15.

Figure 5:
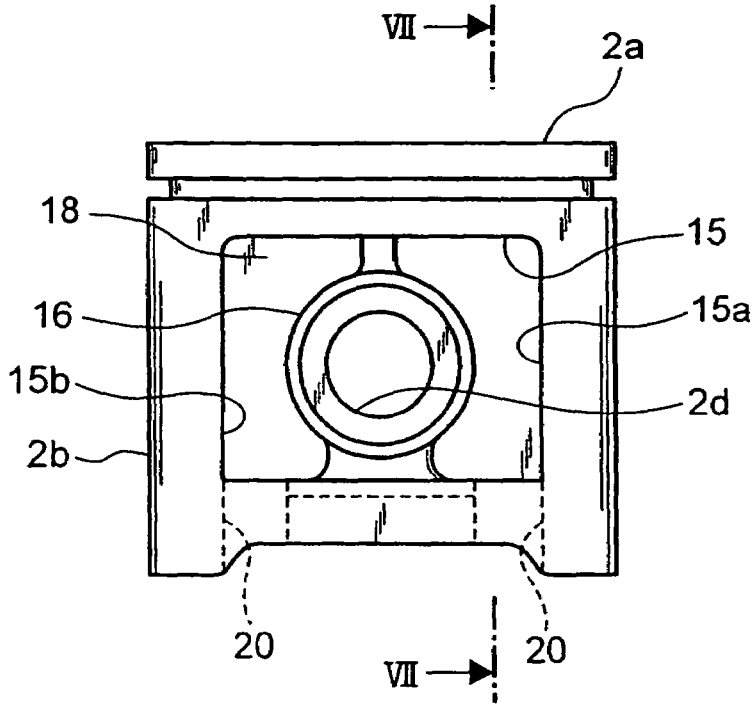
FIG. 5 is a side elevation of the internal cooling piston shown in FIG. 4.
Figure 6:
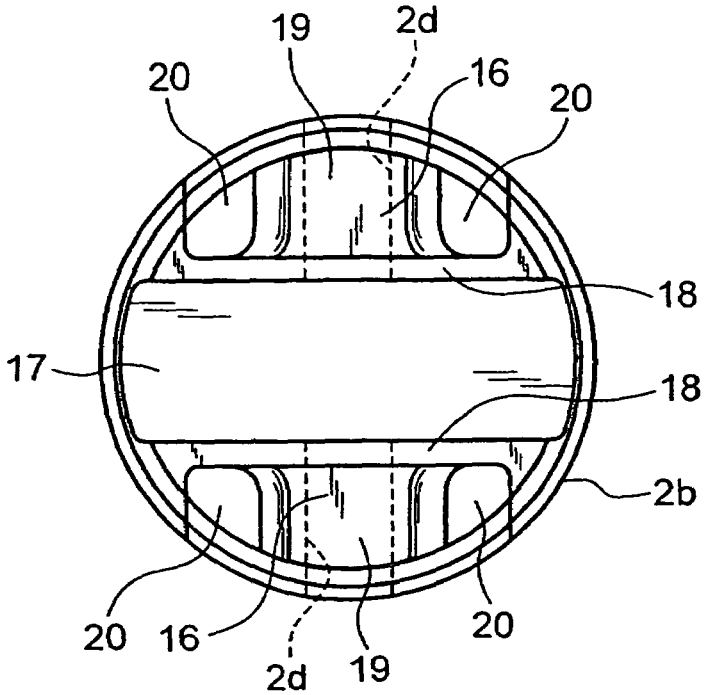
FIG. 6 is a bottom view of the internal cooling piston shown in FIG. 4.
Figure 7:
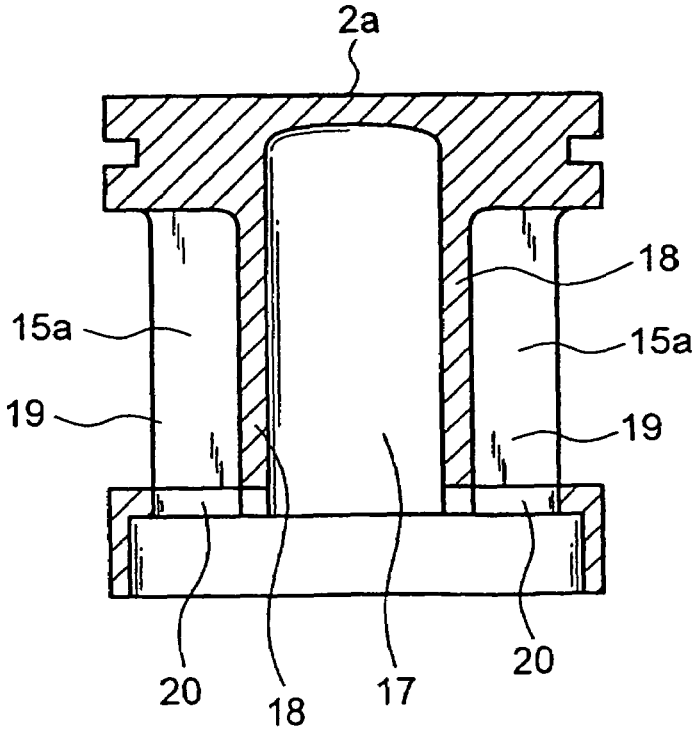
FIG. 7 is a sectional view, taken along the VII-VII line in FIG. 5.

FIG. 5 is a side elevation, FIG. 6 is a bottom view, and FIG. 7 is a sectional view taken along the VII-VII line in FIG. 5, of the piston 2 according to embodiments of the present invention. As shown in FIGS. 5 to 7, the piston 2 has a pair of flat partition walls 18 disposed across a space 17 (as shown in FIG. 6) that receive the upper end of the connecting rod 7. An upper end and both lateral sides of each partition wall 18 are connected integrally to the inner wall of the piston 2. Additionally, the partition walls 18 are connected respectively to inner ends of a pair of piston pin bosses 16 defining the piston pin hole 2*d*. As shown in FIG. 2, the horizontally central portion of the lower end of each partition wall 18 is substantially as high as the lower end of each of the piston pin bosses 16. As shown in FIGS. 6 and 7, the piston 2 has in-piston scavenging passages 19 having an interior portion defined by the two partition walls 18 and right and left inner walls 15*a* and 15*b* of the piston apertures 15, extending downward along the axial line of the piston 2 from the ceiling wall of the piston 2. Lower-end inlets 20 of the in-piston scavenging passages 19 are open downward.

Figure 8:
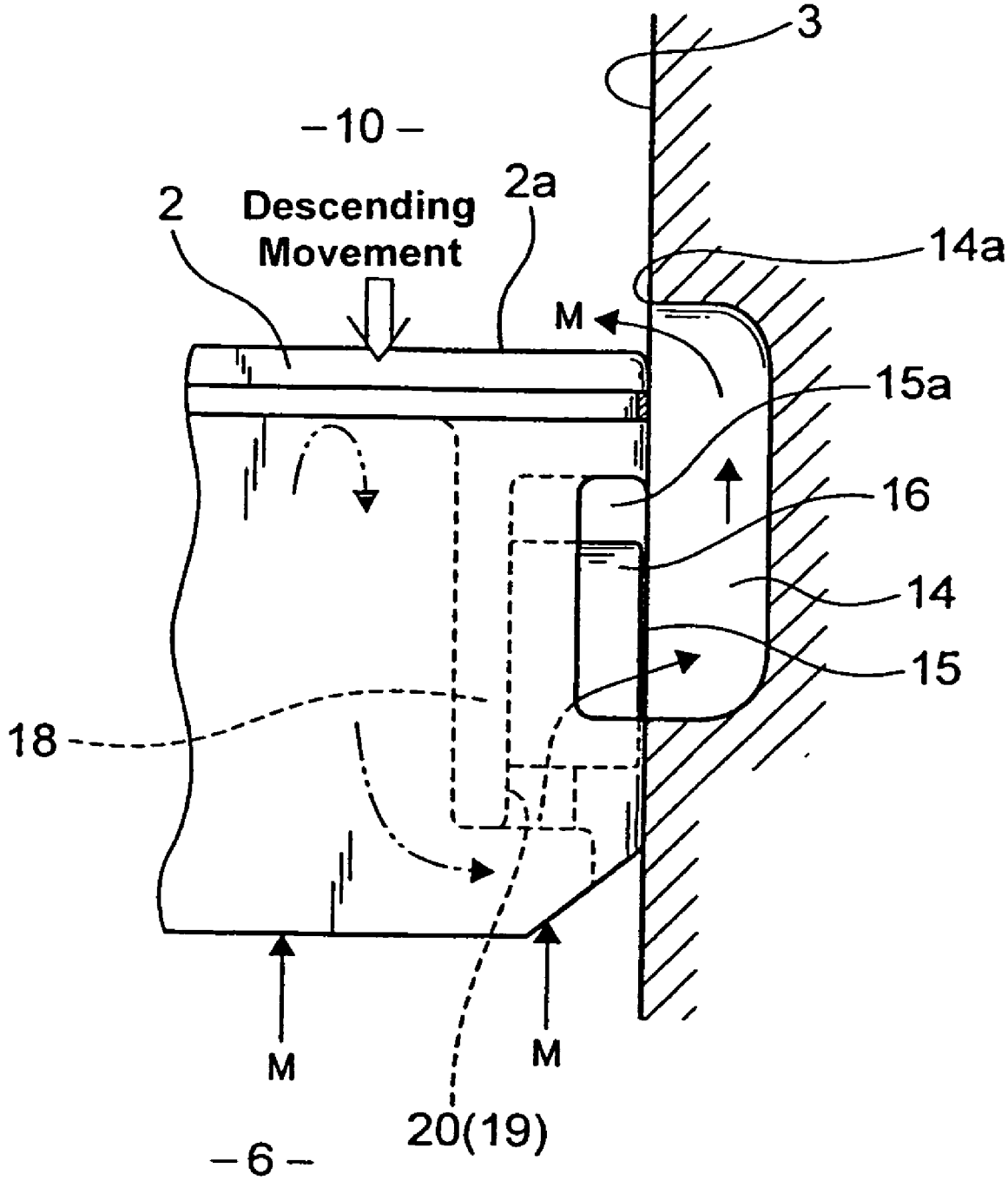
FIG. 8 is a diagram for explaining a scavenging process according to the present invention.

In the two-stroke internal combustion engine 1 having the above-explained construction, as schematically shown in FIG. 8, when the top surface 2*a* of the piston 2 comes below the upper edge 14*a* of the in-cylinder scavenging passages 14 as the piston 2 moves down in the exhaust stroke, the in-cylinder passages 14 open to communication with the combustion chamber 10. Thus, the fresh air-fuel combustion M in the crank chamber 6 travels into the combustion chamber 10 through the in-piston scavenging passages 19, piston apertures 15 and in-cylinder scavenging passages 14. The in-cylinder scavenging passages 14 are preferably configured to send out the fresh air-fuel mixture M in a generally horizontal direction toward the suction port 12. In this manner, the fresh air-fuel mixture M from each of the in-cylinder scavenging passages 14 can effect Schnurle scavenging (reverse scavenging). More specifically, the fresh air-fuel mixture M from each of the in-cylinder scavenging passages 14 hits the cylinder wall at the opposite side away from the exhaust port 13 and turns its flow in the opposite direction. The reversed flow of the fresh mixture M can effectively expel exhaust gas E in the combustion chamber 10 toward the exhaust port 13. That is, the exhaust gas E can be driven away effectively from inside the combustion chamber 10.

As such, the fresh mixture M passes through the piston apertures 15 of the piston 2 after passing through the in-piston scavenging passages 19 reduced in cross-sectional area relative to that of the in-cylinder scavenging passages 14, the reduced cross-sectional area being defined in one regard by the partition walls 18 partitioning the inner space of the piston 2, right and left inner walls 15*a* and 15*b*, lower-end inlets 20 and piston pin bosses 16. Therefore, mixing of fuel and air in the fresh air-fuel mixture M passing through the in-piston scavenging passes 19 can be promoted while the flow rate of the mixture M can be increased. The fresh air-fuel mixture M now having an increased flow rate is discharged from the in-cylinder scavenging passages 14 into the combustion chamber 10 through the piston apertures 15. As a result, Schnurle scavenging can be enhanced, and this contributes to effectively preventing the so-called "blow-by of the exhaust gas", which is the phenomenon wherein the fresh air-fuel mixture M having entered into the combustion chamber 10 is discharged together with the exhaust gas E without contributing to the combustion.

The piston pin bosses 16 are liable to retain heat. Since one of the piston pin bosses 16 is provided in each of the in-piston scavenging passages 19 defined by the partition walls 18, the piston pin bosses 16 can be effectively cooled by the fresh air-fuel mixture M running through the in-piston scavenging passages 19. Simultaneously, carburetion of the fuel component contained in the fresh air-fuel mixture M can be promoted to improve the efficiency of combustion. Further, the fresh air-fuel mixture M having flowed into the space 17 between the pair of partition walls 18 to accommodate the connecting rod stays there, and the lubrication oil contained in the fresh air-fuel mixture M promotes lubrication between the partition walls 18 and connecting rod 7. In addition, while the fresh air-fuel mixture M stays in the space 17, the lubrication oil is separated from the fresh air-fuel mixture M to an appropriate degree, and flows back into the crank chamber 6 without entering the in-piston scavenging passages 19 in an excessive amount. Therefore, even when the content of the lubrication oil in the fresh air-fuel mixture M is reduced, sufficient lubrication is assured, and it is possible to prevent exaggeration of pollution of the exhaust gas E by excessive supply of lubrication oil to the combustion chamber 10.

According to embodiments of the present invention, since the in-piston scavenging passages 19 defined by the partition walls 18 and right and left inner walls 15*a* and 15*b* are narrowed by the inlets 20 and piston pin bosses 16, the flow rate of the fresh air-fuel mixture M passing through the in-piston scavenging passages 19 can be increased even more to further reduce the "blow-by of exhaust gas". In addition, separation of the lubrication oil can be promoted before the fresh air-fuel mixture M enters the in-piston scavenging passages 19. Therefore, sufficient lubrication is ensured even when the lubrication oil contained in the fresh air-fuel mixture M is reduced even more, and pollution of the exhaust gas by the lubrication oil can be reduced even more.

In cases where the two-stroke internal combustion engine 1 according to the present invention is used on, for example, a chain saw, it is possible to prevent the fresh air-fuel mixture M from staying in its liquid form in the crank chamber 6 even though the posture of the engine is changed abruptly, including when the chain saw or other working machine is directed obliquely upward during an idling operation. Therefore, inadvertent interruption of the engine or other malfunctions can be prevented.

Moreover, the piston 2 employed in the two-stroke internal combustion engine 1 according to embodiments of the present invention has the in-piston scavenging passages 19 defined by the partition walls 18 extending along the axial line of the piston 2 to communicate with the piston apertures 15. Therefore, the piston 2 having the partition walls 18 can be formed by casting in substantially the same process as that for producing a conventional piston without such partition walls 18, and the manufacturing cost of the piston 2 can be held at the level of the manufacturing cost of conventional pistons.

Figure 9:
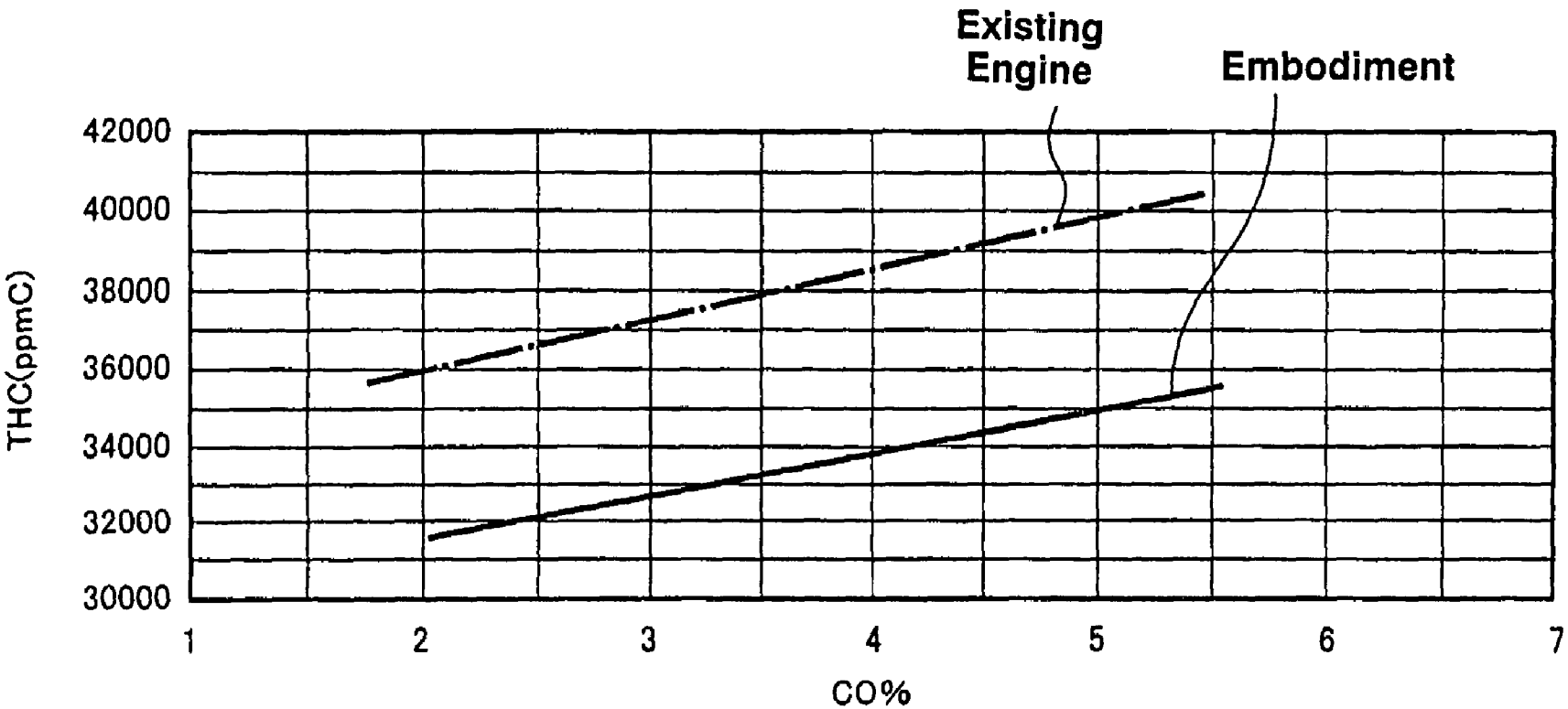
FIG. 9 is a diagram showing data on THC obtained by comparative tests between the two-stroke internal combustion engine using the internal cooling piston according to an embodiment of the present invention and a conventional two-stroke internal combustion engine.
Figure 10:
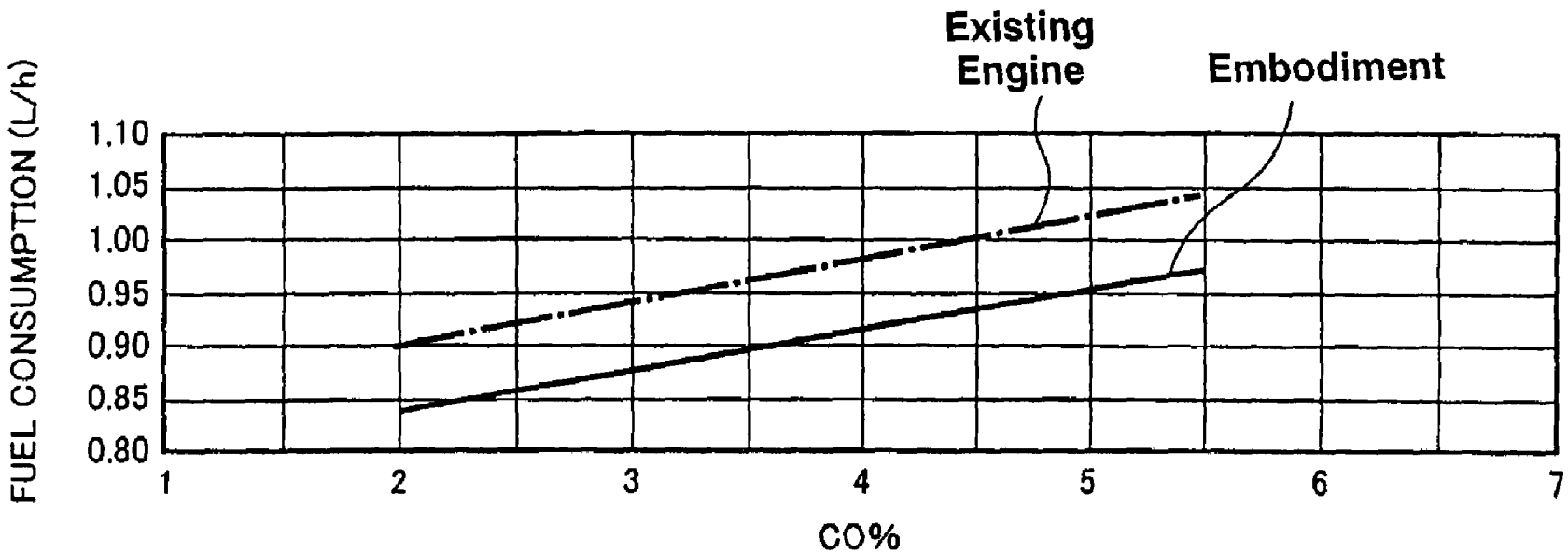
FIG. 10 is a diagram showing data on fuel consumption rates obtained by comparative tests between the two-stroke internal combustion engine using the internal cooling piston according to an embodiment of the present invention and a conventional two-stroke internal combustion engine.

An engine 1 according to embodiments of the invention, having the displacement of 34 cc, was actually produced, and comparative tests were made on this exemplary engine 1 and a sample of an existing two-stroke internal combustion engine having the same displacement and using a piston without partition walls 18 and piston apertures 15. Results of the tests proved that the engine 1 could provide an output of substantially the same as or even greater level than that of the existing engine. Furthermore, the tests demonstrated that the exemplary engine 1 according to embodiments of the present invention was superior to the existing engine in both THC (total unburned combustion components in a fuel), as shown in FIG. 9, and fuel consumption, as shown in FIG. 10.

In the foregoing, a preferred embodiment of the present invention has been illustrated and described. The present invention, however, is applicable to different types of engine as well, including those in which each of in-cylinder scavenging passages 14 comprises two split passages (so-called four-flow scavenging), such as the two-stroke internal combustion engine disclosed in patent document 3. Further, although the piston 2 has been described as having the in-piston scavenging passages 19 opening downward, the lower-end openings of the in-piston scavenging passages 19, i.e., the inlets 20 to the in-piston scavenging passages 19, defined by the partition walls 18 and right and left inner walls 15*a* and 15*b*, may be closed or narrowed. In these and other embodiments, one or more relatively small openings may be formed in the partition walls 18 to thereby effect communication between the crank chamber 6 and in-piston scavenging passages 19.

If the quantity of the air-fuel mixture M to be charged in the combustion chamber 10 is insufficient when the flow rate of the air-fuel mixture M discharged from the in-cylinder scavenging passages 14 into the combustion chamber 10 is increased by defining the in-piston scavenging passes 19 by the partition walls 18 provided inside the piston 2 and/or by limiting the inlets 20 of the in-piston scavenging passages 19, or by limiting the opening area of the piston apertures 15 opening in the circumferential surface 2*b* of the piston 2, then in one or more embodiments sub scavenging passages having a smaller cross-sectional area may be formed in addition to the in-cylinder scavenging passages 14 to effect direct communication between the crank chamber 6 and combustion chamber 10. In this case, the additional sub scavenging passages are preferably configured to open and close synchronously with the in-cylinder scavenging passages 14.

What is claimed is:

1. A two-stroke internal combustion engine, comprising:

a cylinder having in-cylinder scavenging passages formed therein;

a piston fittingly inserted in the cylinder and having piston apertures formed in a circumferential surface thereof;

a crank chamber receiving an air-fuel mixture, the air-fuel mixture being compressed in the crank chamber by a descending movement of the piston;

a combustion chamber receiving the compressed air-fuel mixture from the piston apertures through the in-cylinder scavenging passages to force out exhaust gas to an exhaust port and thereby scavenge the combustion chamber; and in-piston scavenging passages defined by partition walls provided inside the piston to communicate with the piston apertures, the in-piston scavenging passages being in communication with the crank chamber.

2. The two-stroke internal combustion engine according to claim 1, further comprising inlets to receive the air-fuel mixture from the crank chamber into the in-piston scavenging passages, the inlets being narrowed.

3. The two-stroke internal combustion engine according to claim 1, wherein the air-fuel mixture discharged from the in-cylinder scavenging passages to the combustion chamber is directed away from the exhaust port.

4. The two-stroke internal combustion engine according to claim 2, wherein the air-fuel mixture introduced into the crank chamber comprises lubrication oil.

5. The two-stroke internal combustion engine of claim 1, wherein the partition walls extend along the axial line of the piston, and the in-piston scavenging passages are open downward.

6. The two-stroke internal combustion engine of claim 5, wherein the inlets are narrowed by piston pin bosses of the piston.

* * * * *

UNITED STATES PATENT AND TRADEMARK OFFICE

CERTIFICATE OF CORRECTION

PATENT NO. : 7,255,072 B2
APPLICATION NO. : 11/438988
DATED : August 14, 2007
INVENTOR(S) : Yamaguchi It is certified that error appears in the above-identified patent and that said Letters Patent is hereby corrected as shown below:

Column 8, Claim 1, line 9, insert the word --continuously-- before the word “being”.

Signed and Sealed this

Eleventh Day of December, 2007

JON W. DUDAS
*Director of the United States Patent and Trademark Office*